US011380231B2

(12) United States Patent
Lin et al.

(10) Patent No.: US 11,380,231 B2
(45) Date of Patent: Jul. 5, 2022

(54) DISPLAY OFF-TIME SENSING

(71) Applicant: Apple Inc., Cupertino, CA (US)

(72) Inventors: Chin-Wei Lin, San Jose, CA (US); Hung Sheng Lin, San Jose, CA (US); Hyunsoo Kim, Mountain View, CA (US); Hyunwoo Nho, Palo Alto, CA (US); Injae Hwang, Cupertino, CA (US); Jesse A. Richmond, San Francisco, CA (US); Jie Won Ryu, Santa Clara, CA (US); Junhua Tan, Saratoga, CA (US); Kavinaath Murugan, Scarborough (CA); Kingsuk Brahma, Mountain View, CA (US); Shengkui Gao, San Jose, CA (US); Shiping Shen, Cupertino, CA (US); Sun-Il Chang, San Jose, CA (US); Myung-Je Cho, San Jose, CA (US); Yafei Bi, Los Altos Hills, CA (US); Myungjoon Choi, San Jose, CA (US); Weichuan Yao, San Diego, CA (US); Chaohao Wang, Sunnyvale, CA (US)

(73) Assignee: Apple Inc., Cupertino, CA (US)

( * ) Notice: Subject to any disclaimer, the term of this patent is extended or adjusted under 35 U.S.C. 154(b) by 79 days.

(21) Appl. No.: 16/644,932

(22) PCT Filed: Aug. 31, 2018

(86) PCT No.: PCT/US2018/049193
§ 371 (c)(1),
(2) Date: Mar. 5, 2020

(87) PCT Pub. No.: WO2019/060127
PCT Pub. Date: Mar. 28, 2019

(65) Prior Publication Data

US 2021/0150950 A1 May 20, 2021

Related U.S. Application Data

(63) Continuation of application No. 15/870,125, filed on Jan. 12, 2018, now abandoned.
(Continued)

(51) Int. Cl.
*G09G 3/00* (2006.01)
*G09G 3/3208* (2016.01)

(52) U.S. Cl.
CPC ..... *G09G 3/006* (2013.01); *G09G 3/3208* (2013.01); *G09G 2320/045* (2013.01)

(58) Field of Classification Search
CPC ..... G09G 3/006
See application file for complete search history.

(56) References Cited

U.S. PATENT DOCUMENTS

2007/0252785 A1* 11/2007 Nakano ..... G09G 3/2944 345/60
2008/0150839 A1 6/2008 Kawabe
2017/0032723 A1 2/2017 Kim et al.

OTHER PUBLICATIONS

PCT Search Report and Written Opinion for PCT/US2018/049193; dated Jan. 9, 2019, pp. 1-25.
(Continued)

*Primary Examiner* — Gustavo Polo
(74) *Attorney, Agent, or Firm* — Fletcher Yoder P.C.

(57) ABSTRACT

Electronic devices and methods for compensating for aging or other effects in a display during a non-transmitting state (off state) of the display. Sensing may include emissive element sensing of the display and/or thin film transistor sensing of the display. Compensating for the effects may preserve or increase a uniformity of transmission of the display.

18 Claims, 14 Drawing Sheets

Related U.S. Application Data

(60) Provisional application No. 62/562,915, filed on Sep. 25, 2017.

(56) References Cited

OTHER PUBLICATIONS

Vincent Tech, "LG OLED55E6 4K HDR OLED TV Review," HDTVtest, Apr. 27, 2016, http://www.hdtvtest.co.uk/news/oled55e6-201604274285.htm, pp. 1-16.

* cited by examiner

DISPLAY OFF-TIME SENSING

CROSS REFERENCE TO RELATED APPLICATIONS

This application is a national stage filing of PCT Application No. PCT/US2018/049193, filed Aug. 31, 2018, and entitled "Display Off-Time Sensing," which is a continuation of and claims priority to U.S. Non-Provisional application Ser. No. 15/870,125, filed Jan. 12, 2018, and entitled "Display Off-Time Sensing," which claims priority to and the benefit of U.S. Provisional Application No. 62/562,915, filed Sep. 25, 2017, and entitled "Display Off-Time Sensing," the disclosures of which are hereby incorporated by reference in their entireties.

BACKGROUND

The present disclosure relates generally to techniques to sensing non-uniformity in a display. More specifically, the present disclosure relates generally to techniques for sensing non-uniformity in a display in a non-disruptive way, such as during an off state when the display is not actively displaying content.

This section is intended to introduce the reader to various aspects of art that may be related to various aspects of the present disclosure, which are described and/or claimed below. This discussion is believed to be helpful in providing the reader with background information to facilitate a better understanding of the various aspects of the present disclosure. Accordingly, it should be understood that these statements are to be read in this light, and not as admissions of prior art.

Electronic display panels are used in a plethora of electronic devices. These display panels typically include multiple pixels that emit light. The pixels may be formed using self-emissive units (e.g., light emitting diode) or pixels that utilize units that are backlit (e.g., liquid crystal diode). The displays may be compensated for non-uniformity to reduce noise at each pixel of the display. However, sensing for non-uniformity may be affected by content-dependent noise that gives incomplete and/or incorrect compensation.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

Display panel uniformity may be negatively impacted by various parameters (e.g., aging) of the display panel. The display panel uniformity may be improved by sensing for non-uniformity (e.g., aging effects) in a display during an off time of the display to avoid content-based changes to compensation results from the non-uniformity sensing. Furthermore, off-time sensing may reduce battery life of some devices. Thus, a first threshold may be used for determining when to perform off-time sensing during battery-powered conditions, and a second threshold may be set to perform off-time sensing during externally powered conditions. Furthermore, in some embodiments, off-time sensing may be reserved for externally powered conditions.

Moreover, non-uniformity sensing may be divided into thin-film transistor (TFT) sensing and emissive element (e.g., organic light emitting diode—OLED) sensing. Since TFTs exhibit aging effects more quickly, TFT sensing may be performed more frequently than emissive element sensing. To avoid overuse of battery power, when TFT sensing and emissive element sensing are to occur within a same time period (e.g., 1 day), the sensing with the lower frequency (e.g., emissive element sensing) of sensing may be delayed until a next period (e.g., next day).

Sensing noise reduction may utilize multiple scans of each display pixel. Some displays (e.g., mobile phone) may also be switched on and off more frequently than other displays (e.g., television, computer monitors, etc.) In a frequently switched display, the interruption of off-time sensing may cause some data to be lost when only a portion of the pixels of the display are scanned or may cause the sensing to include disadvantageous temporal variations. Instead of scanning each pixel consecutively before moving on to other pixels, some embodiments may include scanning an entire frame before moving to a next frame. Furthermore, if a frame completes, the results of the frame may be saved (even if the scanning process is not fully completed). Only frames that have not completed are discarded since spatial continuity in each frame is preserved at an approximately consistent time. In other words, pixels in the same frame are likely under similar temporal conditions, but pixels before and after an interruption may have quite different temporal conditions. Thus, a frame may be used to group pixels sensing values in approximately consistent temporal conditions.

Some display devices (e.g., desktop monitors, mobile phones) may not experience off-times that are long enough to complete non-uniformity scanning. Thus, in some embodiments, compensation may be predicted/estimated while the display is on between off-time sensing processes. Furthermore, the prediction of the changes (e.g., due to panel aging) may be corrected/fine-tuned based on predicted changes versus measured changes after a scan has been completed. Furthermore, in some embodiments, at least some sensing may overlap at least a portion of other operations (e.g., active panel conditioning) during the off time for the display panel.

BRIEF DESCRIPTION OF THE DRAWINGS

Various aspects of this disclosure may be better understood upon reading the following detailed description and upon reference to the drawings in which.

DETAILED DESCRIPTION OF SPECIFIC EMBODIMENTS

Figure 1:
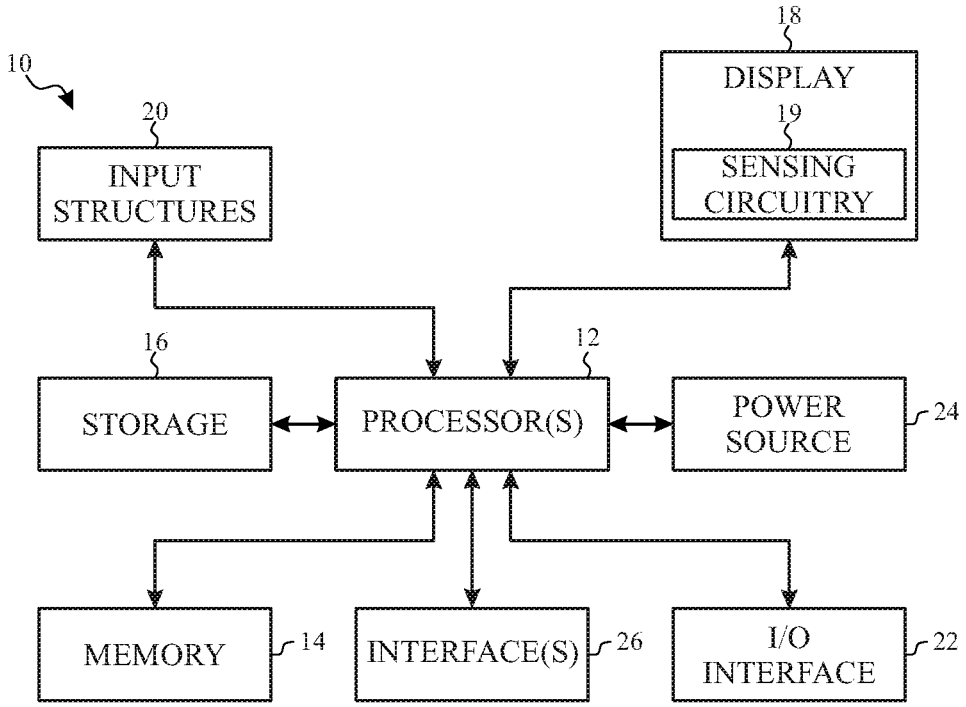
FIG. 1 is a schematic block diagram of an electronic device including a display, in accordance with an embodiment.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Display panel uniformity can be improved by sensing for non-uniformity in a display during an off time of the display to avoid content-based changes to compensation results from the non-uniformity sensing. Furthermore, off-time sensing may reduce battery life of mobile devices. Thus, a first threshold may be used for determining when to perform off-time sensing during battery-powered conditions, and a second threshold may be set to perform off-time sensing during externally powered conditions. Furthermore, in some embodiments, off-time sensing may be reserved for externally powered conditions.

Moreover, non-uniformity sensing may be divided into thin-film transistor (TFT) sensing and emissive element (e.g., organic light emitting diode—OLED) sensing. Since TFTs experience change more quickly, TFT sensing may be performed more frequently than emissive element sensing. To avoid overuse of battery power, when TFT sensing and emissive element sensing are to occur within a same time period (e.g., 1 day), the sensing with the lower frequency (e.g., emissive element sensing) of sensing may be delayed until a next period (e.g., next day).

Sensing noise reduction may utilize multiple scans of each display pixel. Some displays (e.g., mobile phone) may also be switched on and off more frequently than other displays (e.g., television, computer monitors, etc.), In a frequent switching display, the interruption of off-time may cause some data to be lost when only a portion of the pixels of the display are scanned. Instead of scanning each pixel consecutively before moving on to other pixels, some embodiments may include scanning an entire frame before moving to a next frame. Furthermore, if a frame completes, the results of the frame may be saved (even if the scanning process is not fully completed). Only frames that have not completed are discarded since spatial continuity in each frame is preserved. In other words, pixels in the same frame are likely under similar temporal conditions, but pixels before and after an interruption may have quite different temporal conditions. Thus, a frame may be used to group pixels sensing values in approximately consistent temporal conditions.

Some display devices (e.g., desktop monitors, mobile phones) may not experience off-times that are long enough to complete non-uniformity scanning. Thus, in some embodiments, compensation may be predicted/estimated while the display is on between off-time sensing processes. Furthermore, the prediction of the changes (e.g., due to panel aging) may be corrected/fine-tuned based on predicted changes versus measured changes after a scan has been completed.

With the foregoing in mind and referring first to FIG. 1, an electronic device 10 according to an embodiment of the present disclosure may include, among other things, one or more processor(s) 12, memory 14, nonvolatile storage 16, a display 18, input structures 20, an input/output (I/O) interface 22, a power source 24, and interface(s) 26. The various functional blocks shown in FIG. 1 may include hardware elements (e.g., including circuitry), software elements (e.g., including computer code stored on a computer-readable medium) or a combination of both hardware and software elements. It should be noted that FIG. 1 is merely one example of a particular implementation and is intended to illustrate the types of components that may be present in electronic device 10.

In the electronic device 10 of FIG. 1, the processor(s) 12 and/or other data processing circuitry may be operably coupled with the memory 14 and the nonvolatile storage 16 to perform various algorithms. Such programs or instructions, including those for executing the techniques described herein, executed by the processor(s) 12 may be stored in any suitable article of manufacture that includes one or more tangible, computer-readable media at least collectively storing the instructions or routines, such as the memory 14 and the nonvolatile storage 16. The memory 14 and the nonvolatile storage 16 may include any suitable articles of manufacture for storing data and executable instructions, such as random-access memory, read-only memory, rewritable flash memory, hard drives, and/or optical discs. Also, programs (e.g., an operating system) encoded on such a computer program product may also include instructions that may be executed by the processor(s) 12 to enable the electronic device 10 to provide various functionalities.

In certain embodiments, the display 18 may be a liquid crystal display (e.g., LCD), which may allow users to view images generated on the electronic device 10. In some embodiments, the display 18 may include a touch screen, which may allow users to interact with a user interface of the electronic device 10. Furthermore, it should be appreciated that, in some embodiments, the display 18 may include one or more light emitting diode (e.g., LED) displays, or some combination of LCD panels and LED panels. The display 18 may include sensing circuitry 19 that is used to sense non-uniformity of the display 18 by sensing changes in voltage/current through thin-film transistors (TFTs) and/or emissive elements in the display 18.

The input structures 20 of the electronic device 10 may enable a user to interact with the electronic device 10 (e.g., pressing a button to increase or decrease a volume level, a camera to record video or capture images). The I/O interface 22 may enable the electronic device 10 to interface with various other electronic devices. Additionally or alternatively, the I/O interface 22 may include various types of ports that may be connected to cabling. These ports may include standardized and/or proprietary ports, such as USB, RS232, APPLE'S LIGHTNING® connector, as well as one or more ports for a conducted RF link.

As further illustrated, the electronic device 10 may include the power source 24. The power source 24 may include any suitable source of power, such as a rechargeable lithium polymer (e.g., Li-poly) battery and/or an alternating current (e.g., AC) power converter. The power source 24 may be removable, such as a replaceable battery cell.

The interface(s) 26 enable the electronic device 10 to connect to one or more network types. The interface(s) 26 may also include, for example, interfaces for a personal area network (e.g., PAN), such as a BLUETOOTH network, for a local area network (e.g., LAN) or wireless local area network (e.g., WLAN), such as an 802.11 Wi-Fi network or an 802.15.4 network, and/or for a wide area network (e.g., WAN), such as a 3rd generation (e.g., 3G) cellular network, 4th generation (e.g., 4G) cellular network, or long term evolution (e.g., LTE) cellular network. The interface(s) 26 may also include interfaces for, for example, broadband fixed wireless access networks (e.g., WiMAX), mobile broadband Wireless networks (e.g., mobile WiMAX), and so forth.

Figure 2:
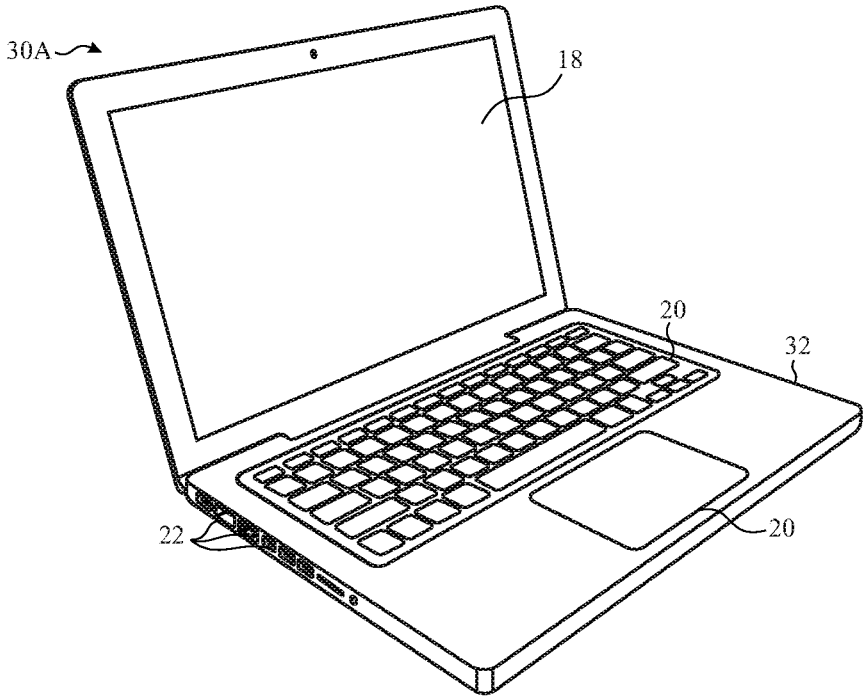
FIG. 2 is a perspective view of a notebook computer representing an embodiment of the electronic device of FIG. 1, in accordance with an embodiment.
Figure 3:
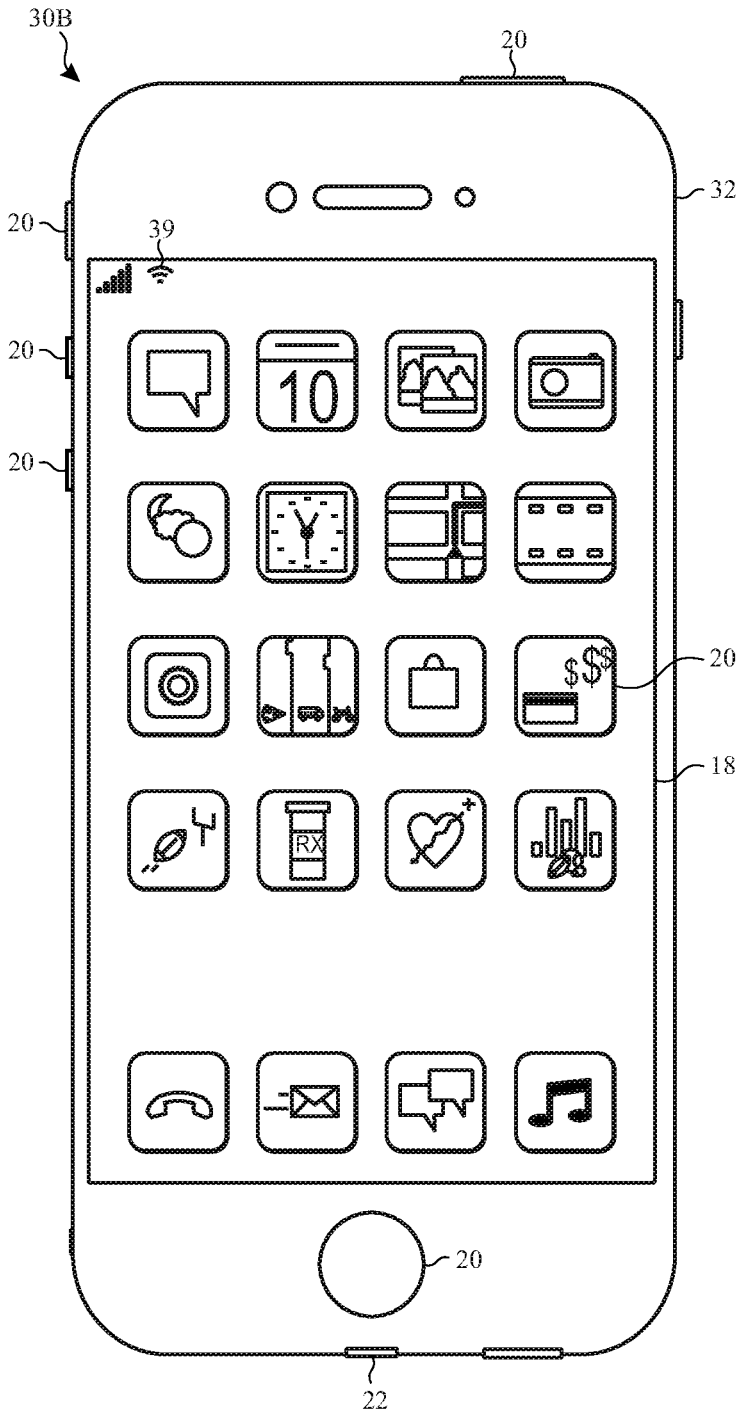
FIG. 3 is a front view of a hand-held device representing another embodiment of the electronic device of FIG. 1, in accordance with an embodiment.
Figure 4:
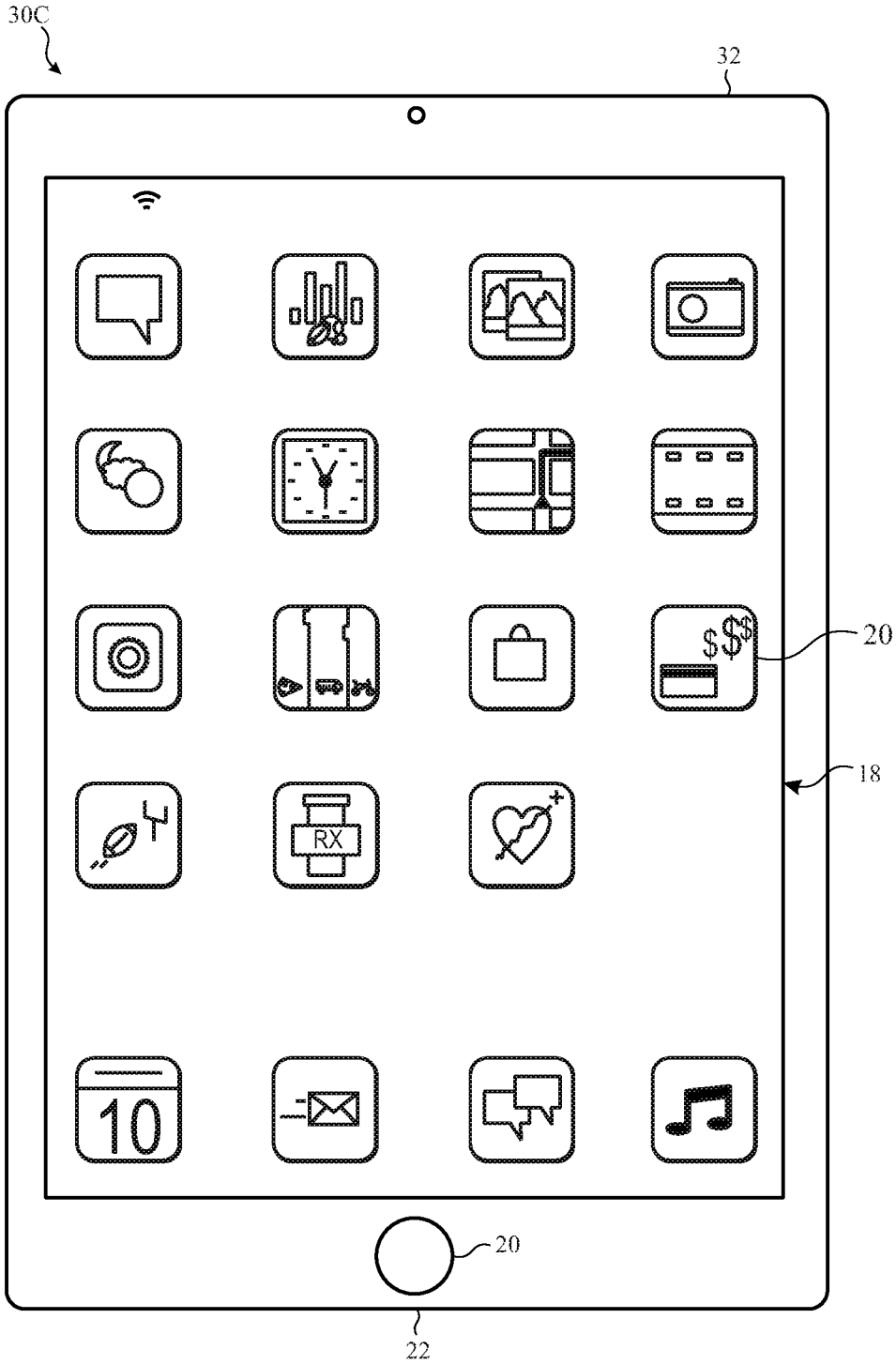
FIG. 4 is a front view of another hand-held device representing another embodiment of the electronic device of FIG. 1, in accordance with an embodiment.
Figure 5:
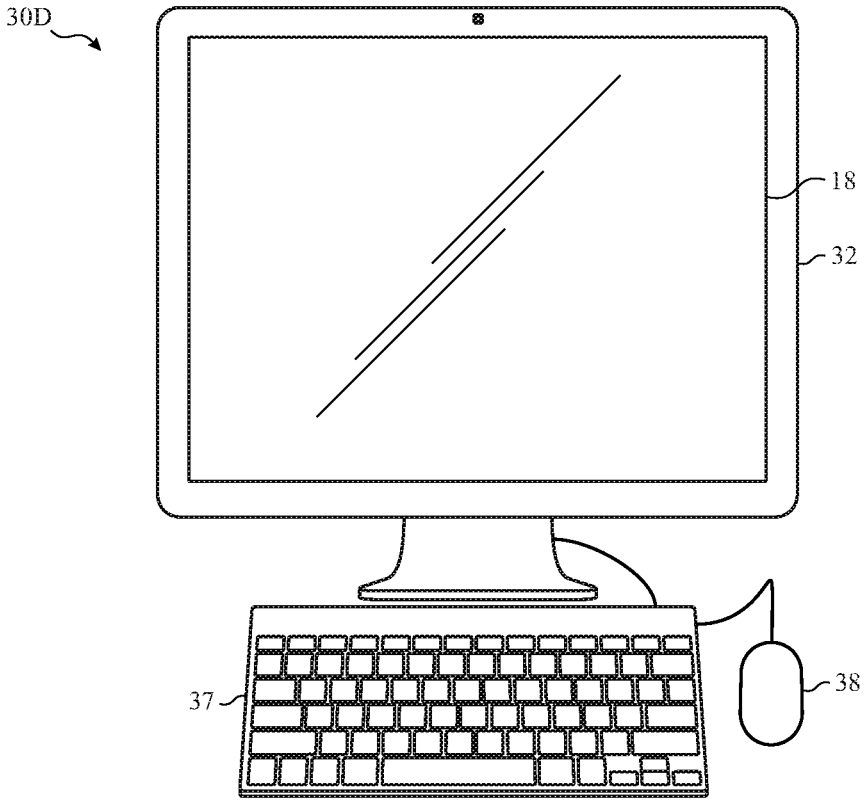
FIG. 5 is a front view of a desktop computer representing another embodiment of the electronic device of FIG. 1, in accordance with an embodiment.
Figure 6:
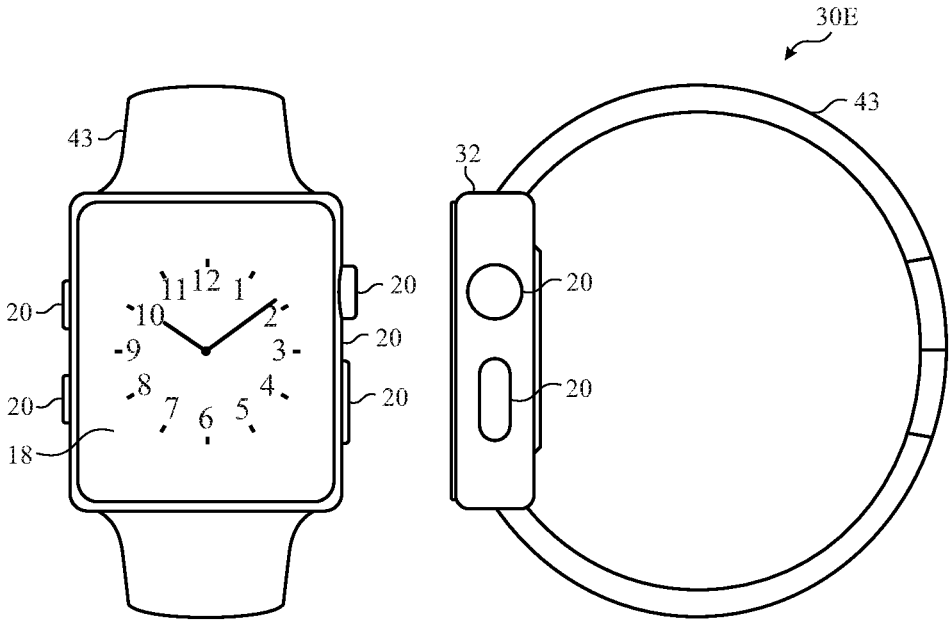
FIG. 6 is a front view of a wearable electronic device representing another embodiment of the electronic device of FIG. 1, in accordance with an embodiment.

By way of example, the electronic device 10 may represent a block diagram of the notebook computer depicted in FIG. 2, the handheld device depicted in either of FIG. 3 or FIG. 4, the desktop computer depicted in FIG. 5, the wearable electronic device depicted in FIG. 6, or similar devices. It should be noted that the processor(s) 12 and/or other data processing circuitry may be generally referred to herein as "data processing circuitry." Such data processing circuitry may be embodied wholly or in part as software, firmware, hardware, or any combination thereof. Furthermore, the data processing circuitry may be a single contained processing module or may be incorporated wholly or partially within any of the other elements within the electronic device 10.

In certain embodiments, the electronic device 10 may take the form of a computer, a portable electronic device, a wearable electronic device, or other type of electronic device. Such computers may include computers that are generally portable (e.g., such as laptop, notebook, and tablet computers) as well as computers that are generally used in one place (e.g., such as conventional desktop computers, workstations and/or servers). In certain embodiments, the electronic device 10 in the form of a computer may be a model of a MACBOOK®, MACBOOK® Pro, MACBOOK AIR®, IMAC®, MAC® mini, or MAC PRO® available from APPLE INC. By way of example, the electronic device 10, taking the form of a notebook computer 30A, is illustrated in FIG. 2 in accordance with one embodiment of the present disclosure. The depicted computer 30A may include a housing or enclosure 32, a display 18, input structures 20, and ports of the I/O interface 22. In one embodiment, the input structures 20 (e.g., such as a keyboard and/or touchpad) may be used to interact with the computer 30A, such as to start, control, or operate a GUI or applications running on computer 30A. For example, a keyboard and/or touchpad may allow a user to navigate a user interface or application interface displayed on display 18.

FIG. 3 depicts a front view of a handheld device 30B, which represents one embodiment of the electronic device 10. The handheld device 30B may represent, for example, a portable phone, a media player, a personal data organizer, a handheld game platform, or any combination of such devices. By way of example, the handheld device 30B may be a model of an IPOD® or IPHONE® available from APPLE INC. of Cupertino, Calif.

The handheld device 30B may include an enclosure 32 to protect interior components from physical damage and to shield them from electromagnetic interference. The enclosure 32 may surround the display 18, which may display indicator icons. The indicator icons may indicate, among other things, a cellular signal strength, BLUETOOTH connection, and/or battery life. The I/O interfaces 22 may open through the enclosure 32 and may include, for example, an I/O port for a hard-wired connection for charging and/or content manipulation using a connector and protocol, such as the Lightning connector provided by APPLE INC., a universal serial bus (e.g., USB), one or more conducted RF connectors, or other connectors and protocols.

The illustrated embodiments of the input structures 20, in combination with the display 18, may allow a user to control the handheld device 30B. For example, a first input structure 20 may activate or deactivate the handheld device 30B, one of the input structures 20 may navigate user interface to a home screen, a user-configurable application screen, and/or activate a voice-recognition feature of the handheld device 30B, while other of the input structures 20 may provide volume control, or may toggle between vibrate and ring modes. Additional input structures 20 may also include a microphone that may obtain a user's voice for various voice-related features, and a speaker to allow for audio playback and/or certain phone capabilities. The input structures 20 may also include a headphone input (not illustrated) to provide a connection to external speakers and/or headphones and/or other output structures.

FIG. 4 depicts a front view of another handheld device 30C, which represents another embodiment of the electronic device 10. The handheld device 30C may represent, for example, a tablet computer, or one of various portable computing devices. By way of example, the handheld device 30C may be a tablet-sized embodiment of the electronic device 10, which may be, for example, a model of an IPAD® available from APPLE INC. of Cupertino, Calif.

Turning to FIG. 5, a computer 30D may represent another embodiment of the electronic device 10 of FIG. 1. The computer 30D may be any computer, such as a desktop computer, a server, or a notebook computer, but may also be a standalone media player or video gaming machine. By way of example, the computer 30D may be an IMAC®, a MACBOOK®, or other similar device by APPLE INC. It should be noted that the computer 30D may also represent a personal computer (e.g., PC) by another manufacturer. A similar enclosure 32 may be provided to protect and enclose internal components of the computer 30D such as the display 18. In certain embodiments, a user of the computer 30D may interact with the computer 30D using various peripheral input devices, such as the keyboard 37 or mouse 38, which may connect to the computer 30D via an I/O interface 22.

Similarly, FIG. 6 depicts a wearable electronic device 30E representing another embodiment of the electronic device 10 of FIG. 1 that may be configured to operate using the techniques described herein. By way of example, the wearable electronic device 30E, which may include a wristband 43, may be an APPLE WATCH® by APPLE INC. However, in other embodiments, the wearable electronic device 30E may include any wearable electronic device such as, for example, a wearable exercise monitoring device (e.g., pedometer, accelerometer, heart rate monitor), or other device by another manufacturer. The display 18 of the wearable electronic device 30E may include a touch screen (e.g., LCD, an organic light emitting diode display, an active-matrix organic light emitting diode (e.g., AMOLED) display, and so forth), which may allow users to interact with a user interface of the wearable electronic device 30E.

Although the following discusses sensing current through an OLED as a pixel, some embodiments may include measuring other parameters suitable for other pixel types. For example, LED voltage may be sensed at LED pixels in the display.

Figure 7:
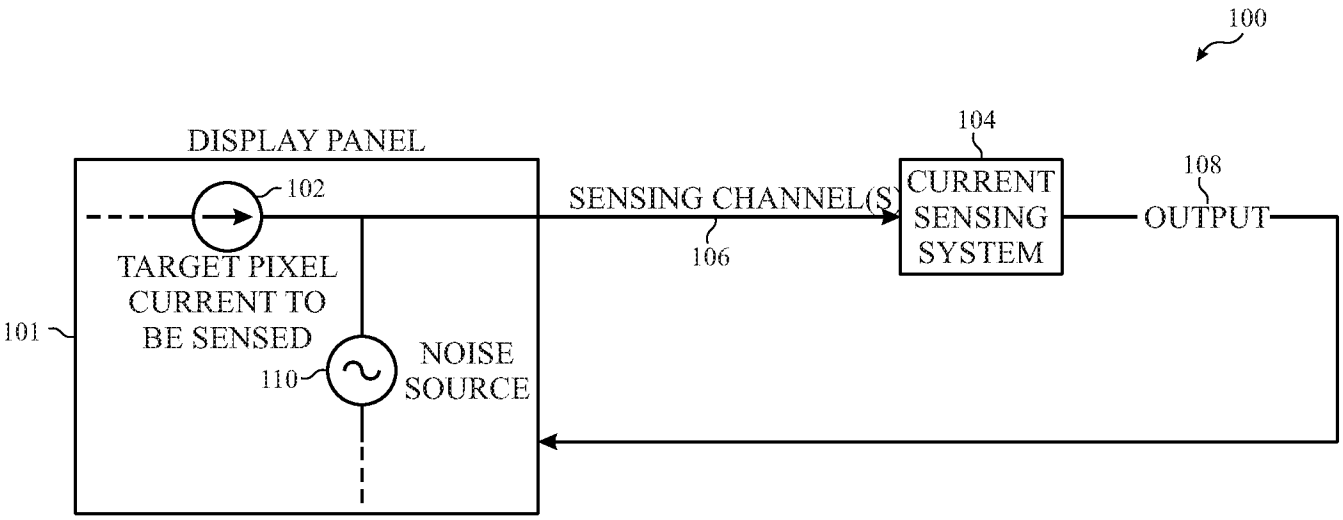
FIG. 7 illustrates a block diagram view of a current sensing scheme, in accordance with an embodiment.

FIG. 7 illustrates a block diagram view of a current sensing scheme 100 in the sensing circuitry 19 of the display 18 used to sense changes in a display panel 101 of the display 18. As illustrated, a target pixel current is provided via a current source 102. The current provided by the current source 102 then is supplied to a current sensing system 104 via sensing channel(s) 106. The sensing channel 106 may include single-ended or a differential channel(s). The current sensing system 104 then outputs an output 108 that is used to compensate display panel operation. In other words, in the current sensing scheme 100, a channel 106 is used to detect or estimate pixel current directly from a target pixel. Furthermore, the current sensing scheme 100 may also be used to detect or estimate current and/or voltages of TFTs of the display panel. In such sensing modes, current through the emissive element of the pixel may be avoided by switching one more switches (e.g., TFTs). Additionally, the current sensing (i.e., emissive element sensing) may be performed using a relatively low current/voltage to reduce likelihood of detection of the sensing on the display panel 101. Furthermore, in some embodiments, TFT sensing may utilize low currents/voltages to reduce likelihood of visibility of the sensing. Moreover, the current sensing scheme 100 may include amplifiers, filters, analog-to-digital converters, digital-to-analog converters, and/or other circuitry used for processing in the current sensing scheme 100 that have been omitted from FIG. 7 for clarity.

As previously noted, non-uniformity sensing for some displays may be unsuitable for other displays. For example, sensing schemes used on devices that are always powered by external power may be unconcerned with available power. Thus, such schemes may not be suitable for displays that use an internal power source (e.g., battery). Instead, in displays that utilize limited power (e.g., battery), prioritization of sensing based on thresholds and available power may be used.

Figure 8:
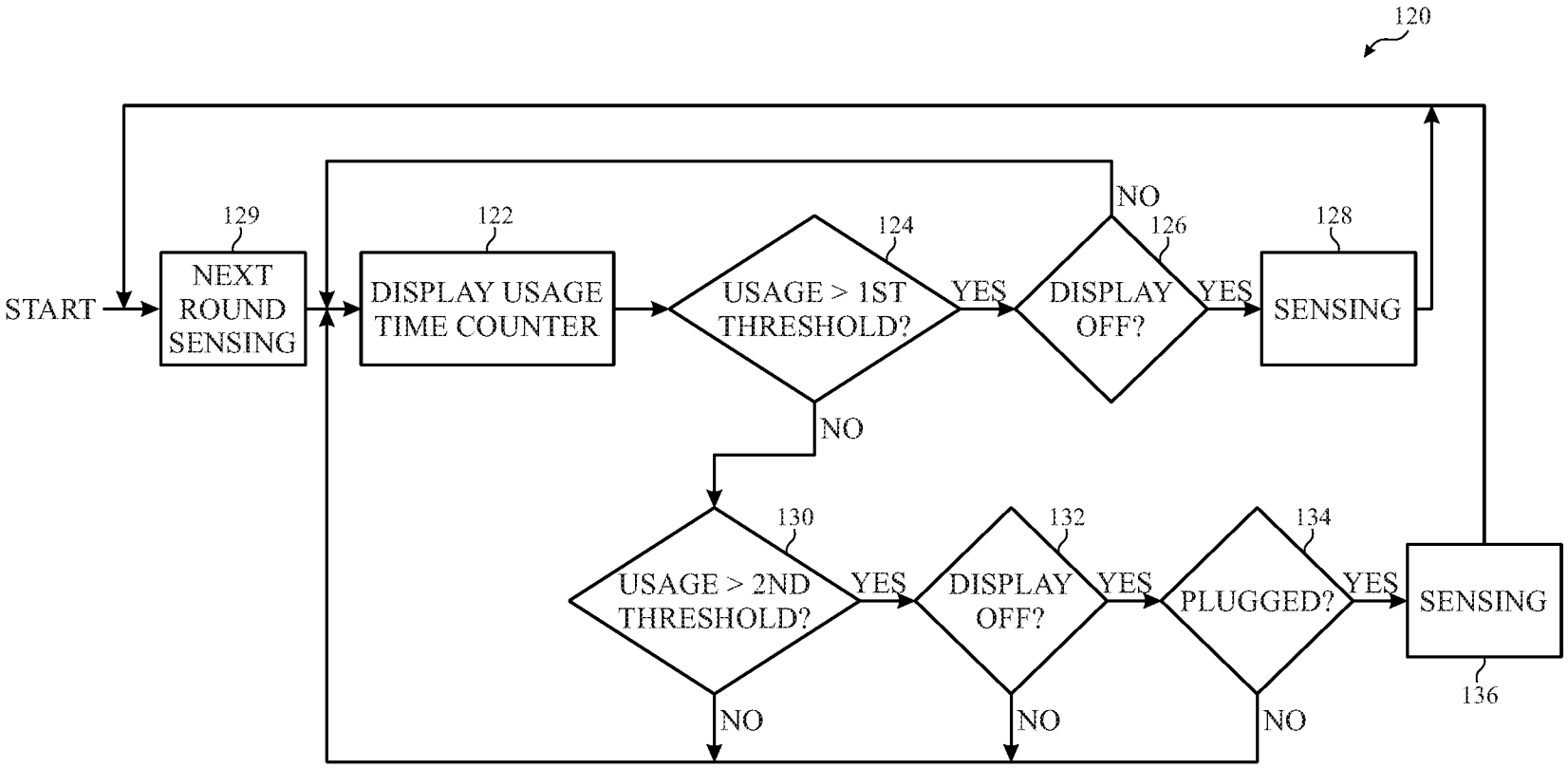
FIG. 8 illustrates a flow diagram view of a process for using two thresholds to determine when to enable off-time sensing, in accordance with an embodiment.

FIG. 8 illustrates a dual-threshold process 120 used for sensing in the sensing circuitry 19 and/or the processor(s) 12. Although the following discusses that the sensing circuitry 19 performs various steps, at least a portion of the steps attributed to the sensing circuitry 19 may be performed using some processing from the processor(s) 12. With this is mind, the sensing circuitry 19 tracks display usage using a display usage time counter 122. The display usage time counter 122 may track how long the display has been on either as an overall number of usage for the display 18 or as a relative number of usage of the display 18 only since a last sensing. The sensing circuitry 19 then determines whether this display usage time counter 122 has surpassed a first threshold (block 124). If the display usage time counter 122 has exceeded this first threshold the sensing circuitry 19 determines whether the display 18 is off (block 126). If the display 18 is off, the sensing circuitry 19 begins performing sensing (block 128). However, when the display 18 is on and/or when the display usage time counter 122 has surpassed the first threshold, the sensing circuitry 19 delays the sensing to a next round sensing (block 129).

In addition to the first threshold, the sensing circuitry 19 may utilize a second threshold. The first threshold may correspond to a high number (e.g., a long period of use) relative to the second threshold. The second threshold may be utilized to cause sensing when more power is available. For example, the second threshold may be used to provide sensing when AC power is connected to the electronic device 10 before the first threshold causes sensing regardless of external power availability.

The sensing circuitry 19 determines whether the display usage time counter 122 has surpassed the second threshold (block 130). If the display usage time counter 122 has surpassed the second threshold, the sensing circuitry 19 determines whether the display 18 is off (block 132). If the display 18 is off, the sensing circuitry 19 determines whether the electronic device 10 is plugged into an external power supply (block 134). For example, the electronic device may be powered using an external AC adapter in addition to or alternative to battery power. If external power is provided to the electronic device 10, the sensing circuitry 19 performs the sensing scan, as previously discussed (block 136). However, if the sensing circuitry determines that the display usage time counter 122 has not surpassed second threshold, the display is on, and/or the electronic device is not plugged into external power, the sensing circuitry 19 delays sensing until a next round sensing. In some embodiments, the first and second thresholds may be evaluated in a different order. For example, in certain embodiments, the second threshold may be evaluated before the first threshold is evaluated to prefer evaluating whether a plugged sensing threshold should be used before determining whether a non-plugged sensing threshold should be used. Additionally or alternatively, in some embodiments, a determination may be made to determine whether the display is receiving external power before using a threshold. In certain such embodiments, only a single threshold may be used with the first threshold used when external power is not connected and the second threshold used when external power is connected.

As previously discussed, sensing may include various sensing types. For example, a first sensing type may be used to sense aging in TFTs and a second sensing type may be used to sense aging of emissive elements. Since TFTs and emissive elements may reflect aging changes at different rates, these sensing processes may occur at different intervals. Thus, the two sensing types may be scheduled to occur at different times, but, in some embodiments, these schedules may conflict (e.g., occur at the same time). When both sensing types are to occur at the same time and/or within a same duration, drain on an internal power supply (e.g., battery) may be excessive.

Figure 9:
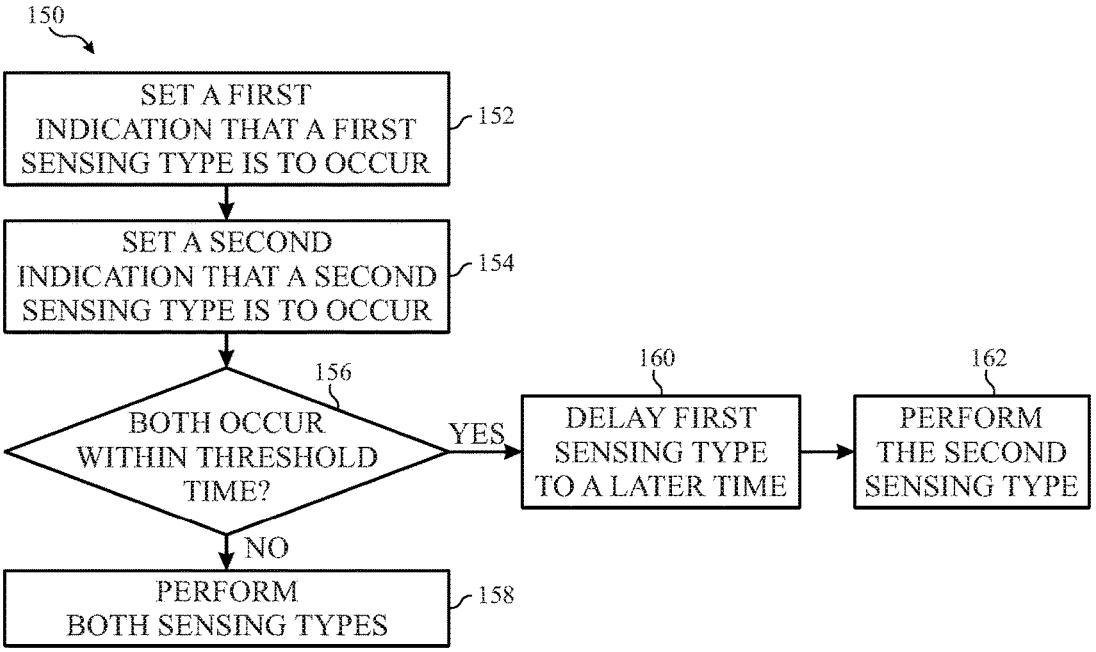
FIG. 9 illustrates a flow diagram view of a process for using the two thresholds of FIG. 8, in accordance with an embodiment.

Thus, the sensing circuitry 19 may utilize some conflict resolution between the two sensing process types. FIG. 9 illustrates a process 150 that may be used to resolve these conflicts. The sensing circuitry 19 sets a first indication that a first sensing type is to occur (block 152). For example, a first sensing type may include emissive element sensing, such as sensing an aging of an organic light emitting diode (OLED). The sensing circuitry 19 may also set a second indication that a second sensing type is to occur (block 154). The second sensing type may include sensing of TFTs in the display 18. The sensing circuitry 19 may determine whether both of these sensing types are to occur within a threshold time (block 156). For example, the threshold time may include a duration in which battery drain is potentially excessive by performing both sensing types within the threshold time. For instance, the threshold time may include a number of seconds, minutes, hours, days, or weeks.

If both sensing types do not occur within the threshold time, the sensing circuitry 19 may perform both sensing types at the indicated corresponding times (block 158). However, both sensing types are to occur within the threshold time, the sensing circuitry 19 may delay the first sensing type to a later time (block 160). The sensing type to be delayed may be selected based on which sensing type has a longer interval between sensing occurrences. For example, a sensing type that occurs less frequently may be delayed because the underlying sensed parameter may reflect aging changes less frequently. For instance, aging of the emissive elements may be less severe in appearance than the changes caused by aging of TFTs. Thus, in some embodiments, sensing of emissive elements may be delayed until later time while the second sensing type may still be performed by the sensing circuitry 19 (block 162).

Figure 10:
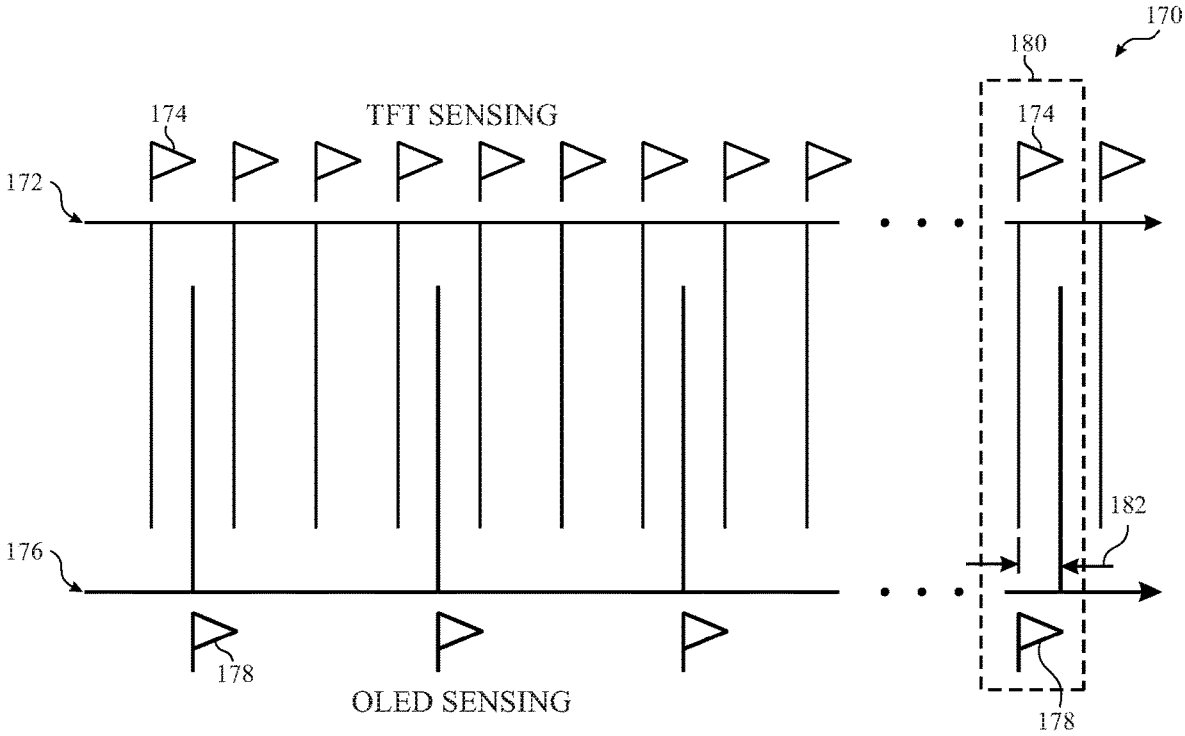
FIG. 10 illustrates a diagram of conflict resolution between two sensing types for a display, in accordance with an embodiment.

FIG. 10 illustrates a timing diagram 170 of two sensing types. The timing diagram illustrates TFT sensing 172. The sensing circuitry 19 may also set an indicator 174 that indicates that the TFT sensing 172 is to occur. For example, the indicator 174 may include a flag in the memory 14 indicating a specific time or window in which the sensing is to occur. Additionally or alternatively, the indicator 174 may indicate that the sensing is to be applied at a next available sensing possibility. The timing diagram 170 also illustrates sensing for an emissive element such as an OLED sensing 176. The OLED sensing 176 may also utilize an indicator 178 that indicates when the OLED sensing 176 is to occur. At point in time 180, an indication 174 is set for TFT sensing 172, and an indication 178 is set for an OLED sensing 176. As illustrated, the indicators 174 and 178 occur at the same time or within the time threshold. To alleviate power issues due to off-time sensing using two different sensing types, the sensing circuitry 19 delays OLED sensing 176 by a duration 182. The duration 182 may be equal to the time threshold or maybe a separate value.

Figure 11A:
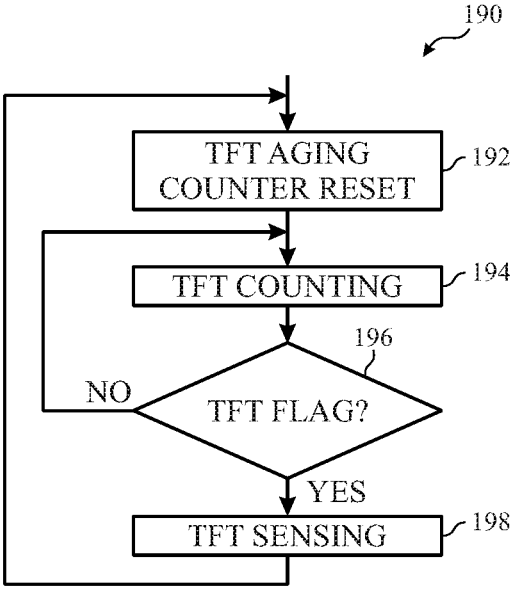
FIG. 11A illustrates a flow diagram view of a process for conflict resolution for a first sensing type of the two sensing types of FIG. 10, in accordance with an embodiment.
Figure 11B:
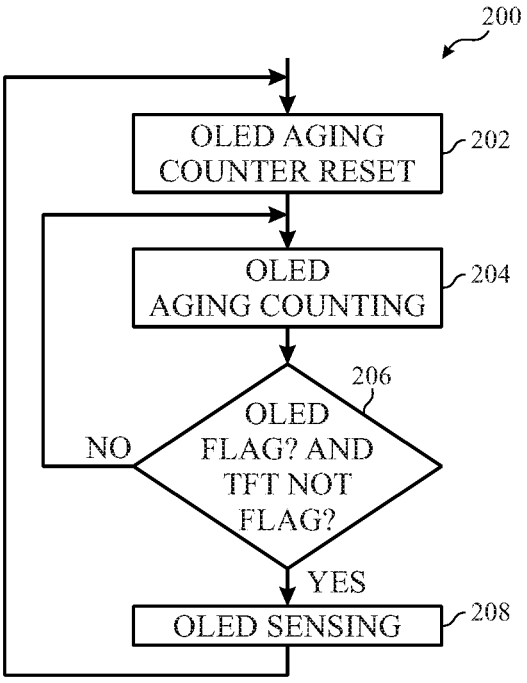
FIG. 11B illustrates a flow diagram view of a process for conflict resolution for a second sensing type of the two sensing types of FIG. 10, in accordance with an embodiment.

FIGS. 11A and 11B illustrate processes 190 and 200 used to implement the conflict resolution of FIGS. 9 and 10. The process 190 includes resetting a TFT aging counter (block 192). This reset may be used to track usage of the display 18 since a last TFT sensing 172. The sensing circuitry 19 then counts usage for display 18 by incrementing the TFT aging counter (block 194). The sensing circuitry 19 then determines whether this TFT aging counter has invoked a TFT flag (block 196). For example, the TFT flag may be invoked as the indicator 174 once the TFT aging counter has reached a threshold. In some embodiments, the threshold may include the first threshold or the second threshold in accordance with the discussion related to FIG. 8.

Once the TFT flag is set, the sensing circuitry 19 performs TFT sensing (block 198). Once TFT sensing has been performed, the sensing circuitry 19 resets the counter and may begin the process 190 over again.

Similar to the process 190, the sensing circuitry 19 utilizes process 200 to control OLED sensing 176. The sensing circuitry 19 reset an OLED aging counter (202). Using the reset OLED aging counter, the sensing circuitry 19 tracks usage of the display 18 using OLED aging counting (block 204). The sensing circuitry 19 then determines whether the OLED flag has been set and the TFT flag has not been set (block 206). Similar to setting of the TFT flag, the sensing circuitry 19 may determine whether the OLED aging counter has surpassed the first and/or second threshold as discussed in FIG. 8 previously. If the OLED flag is set and the TFT flag is not set, OLED sensing is performed (block 208). However, if the OLED flag is not set or the TFT flag is set, the sensing circuitry 19 continues counting OLED aging. In some embodiments, the sensing circuitry 19 may temporarily increment the threshold setting to ensure that the OLED sensing 176 only occurs after the duration 182 elapses after the corresponding TFT sensing 172.

Figure 12:
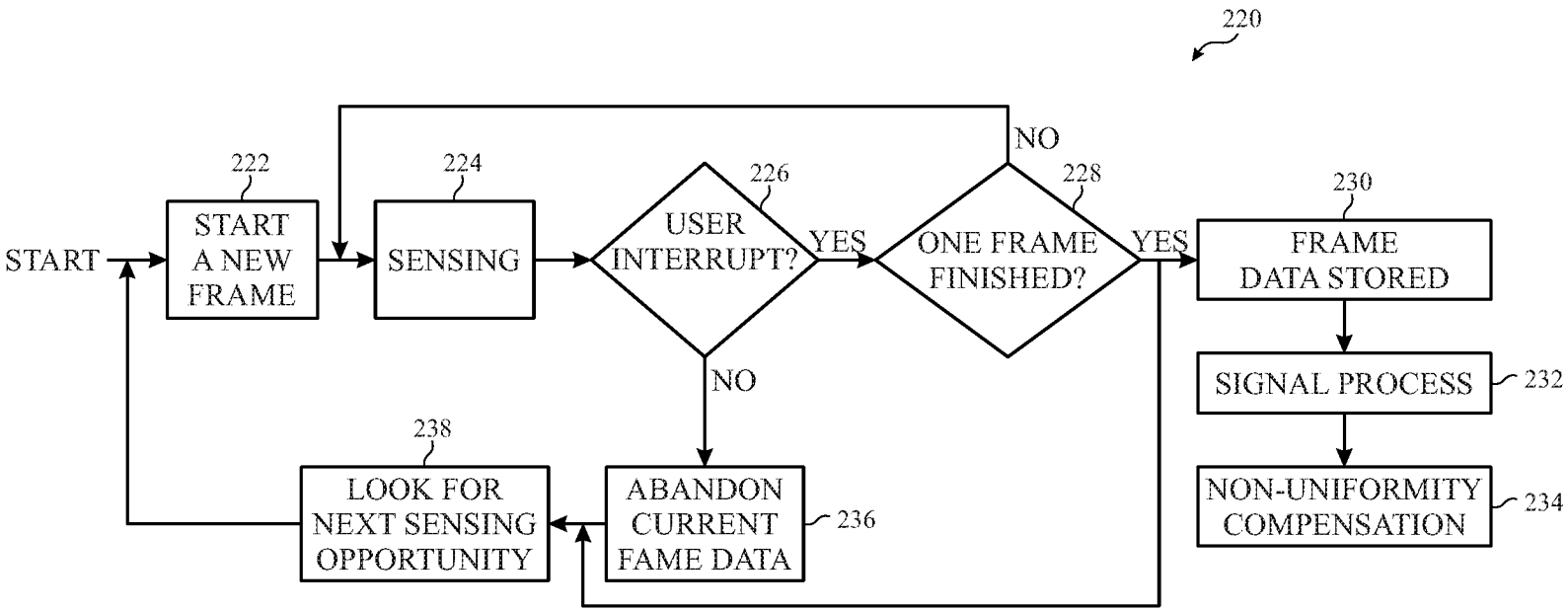
FIG. 12 illustrates a flow diagram view of a process for performing frame-by-frame sensing of a display, in accordance with an embodiment.

As previously discussed, a sensing scan may use more than a single pass of pixels of the display 18. However, the display 18 may be turned on during scans. Accordingly, data gathered in an incomplete sensing may not be completely useful for compensating for non-uniformity since an incomplete scan of the display 18 with subsequent completion may capture different display parameters under disparate conditions. For example, temperature and/or aging variations may cause the pixels of the display 18 to behave differently due to scans being run at different times. Instead, at least a portion of the incomplete scans may be discarded. Specifically, if a scan includes scanning each pixel more than once before moving on to a next pixel, the scan may be more likely to cause discarding of a relatively high number of pixel data. Instead, a scan may include one or more frames where each pixel is scanned before moving on to a next state. Thus, a first pass of the sensing circuitry 19 may be kept even if later frames are not completed. FIG. 12 illustrates a process 220 for applying sensing scans in a frame-by-frame manner. The sensing circuitry 19 starts a new frame starting a first pixel (block 222). For example, the new frame may be a first frame of a sensing scan. Moreover, the new frame may begin in a first corner of the display 18 (e.g., top-left corner) and end in another corner of the display 18 (e.g., bottom-right corner). The sensing circuitry 19 conducts sensing in the first frame (block 224). The sensing circuitry 19 and/or the processor(s) 12 may determine whether a user interrupt has occurred (block 226). For example, the sensing circuitry 19 and/or the processor(s) 12 may determine whether input structures 20 have been used to awaken the display 18 from an off state.

When no user interrupt has been detected, the sensing circuitry 19 and/or the processor(s) 12 determines whether the frame is finished (block 228). If the frame has not been completed, the sensing circuitry 19 continues sensing the frame. Once the frame has been completed, the sensing circuitry 19 and/or the processor(s) 12 store frame data to be used for compensating operation of the display 18 (block 230). The frame data may be stored in the memory 14. The sensing circuitry 19 may indicate that the sensing operation has update compensation values (block 232). The processor(s) 12 then use the updated compensation values from memory 14 to compensate for non-uniformity in the display 18 (block 234).

If the sensing circuitry 19 and/or the processor(s) 12 determine that a user interrupt has occurred before the currently scanned frame has been completed, the sensing circuitry 19 and/or the processor(s) 12 abandon current frame data (block 236). For example, the sensing circuitry 19 and/or the processor(s) 12 may delete the frame data from volatile memory prior to storing compensation values in non-volatile memory. Additionally or alternatively, frame data may be stored in non-volatile memory during a scan, but the signal to indicate that the frame has not completed is suppressed. Furthermore, the frame data in the non-volatile memory may be deleted. Moreover, in some embodiments, the frame data may be deleted if a threshold of time has elapsed since a frame has begun without completing the frame. Once frame data has been discarded, the sensing circuitry 19 looks for a next sensing opportunity (block 238). For example, the sensing circuitry 19 may wait until the display 18 is turned off to start a new frame scan. In some embodiments, the sensing circuitry 19 may wait until a threshold of time has elapsed from the last on state during the current off-time before attempting to scan a new frame again.

Figure 13:
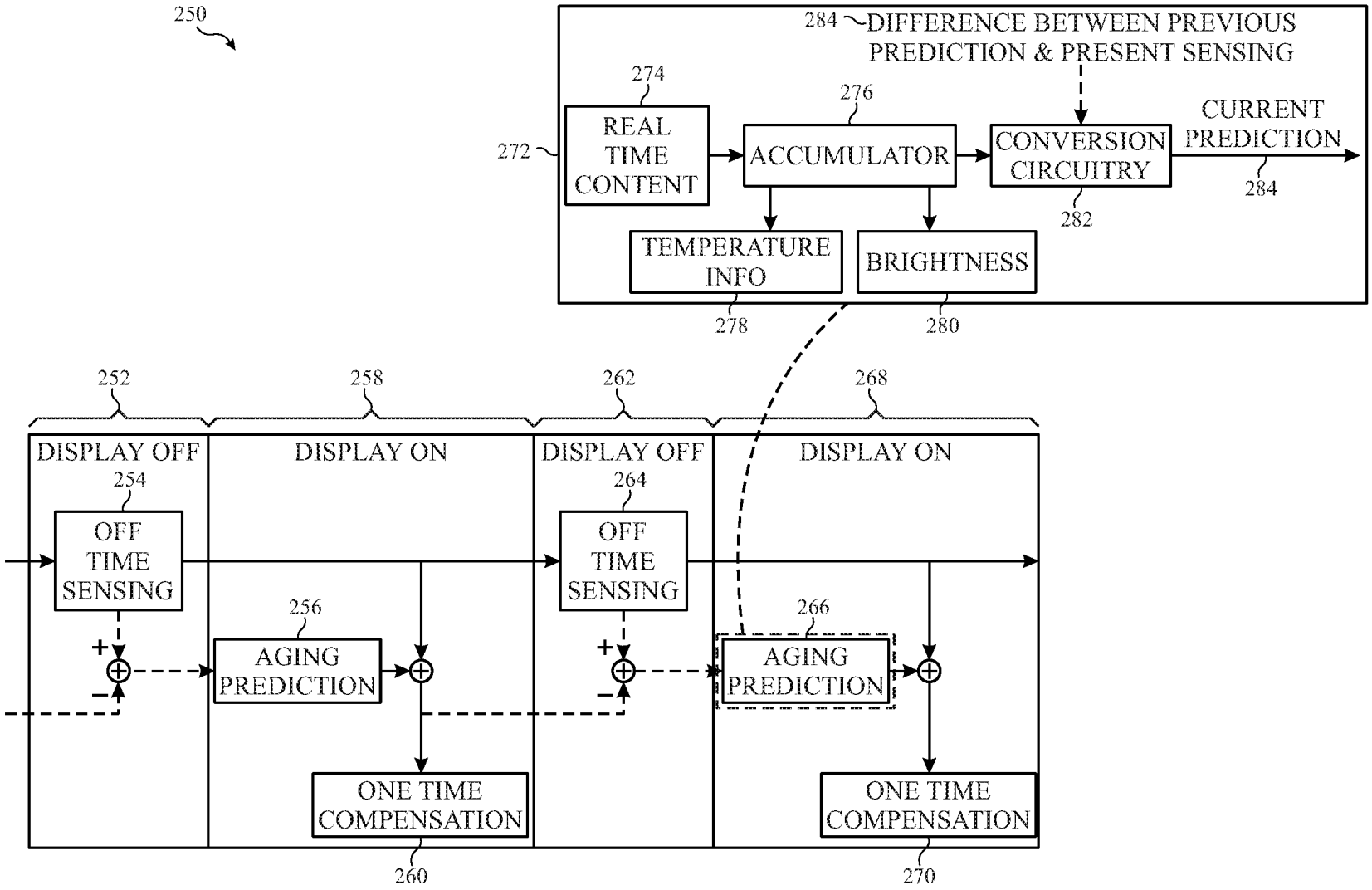
FIG. 13 illustrates a block diagram view of on state estimation of aging, in accordance with an embodiment.

Since sensing frames are performed during an off-state, the compensation values for the display 18 may not be updated while the display 18 is on. In some situations, the display 18 may remain on for an extended duration. During this duration, the display 18 uniformity may decrease without adjusted compensation being applied. To address this situation, the processor(s) 12 may estimate compensation while the display 18 is on. FIG. 13 illustrates a process 250 used to estimate compensation changes during sequential on and off states. During an off state 252 for the display 18, the sensing circuitry 19 performs Off-time sensing 254. During a later on state 258, the processor(s) 12 and/or the sensing circuitry 19 uses the Off-time sensing 254 to calculate an aging prediction 256. This aging prediction 256 is then added to the results of the Off-time sensing 254 to generate the on time compensation 260 to drive the display 18 during the on state 258 since the aging of the display 18 only increases during the on state 258.

Furthermore, the aging prediction 256 is used to fine tune previous on time compensations since the aging prediction 256 is a difference between Off-time sensing 254 and a previous on time compensation. Similarly, the on time compensation 260 may be used in future compensations. For example, during a subsequent off state 262, the sensing circuitry 19 performs Off-time sensing 264. The results of this sensing scan are subtracted from the previous on time compensation 260 to calculate the aging prediction 266. In other words, the aging prediction 266 is based on how far off the on time compensation 260 is from the values determined during the Off-time sensing 264. During the on state of the display 18, the aging prediction 266 is added to the results of the Off-time sensing 264 to generate the on time compensation 270.

Running compensation 272 illustrates how the past values are used to predict future aging compensation. The running compensation 272 receives real-time content 274 into an accumulator 276 that tracks on time for the display 18 and the usage of the display 18 based on the real-time content 274 since a previous Off-time sensing. Real-time content 274 may include content as it is being displayed. Additionally or alternatively, the real-time content 274 may include any data since a last Off-time sensing within a period of time small enough that the aging effects on the display may be small and/or unnoticeable to a user. The accumulator 276 also receives temperature information 278 and brightness level 280 that are both relevant to usage and/or aging. The real-time content 274 since the last Off-time sensing is accumulated and passed to conversion circuitry 282 that maps grayscale levels in the real-time content to a correction voltage based on the temperature information 278, the brightness level 280, and difference between a previous prediction and a present sensing 284. In other words, the conversion circuitry 282 may calculate a correction voltage that is used to offset predicted aging in the display 18 due to the real-time content 274 displayed at a temperature indicated in the temperature information 278 at the brightness level 280. This correction voltage is also fine-tuned by indicating how much the previous prediction using the calculation varied from the sensed correction voltage level.

Figure 14:
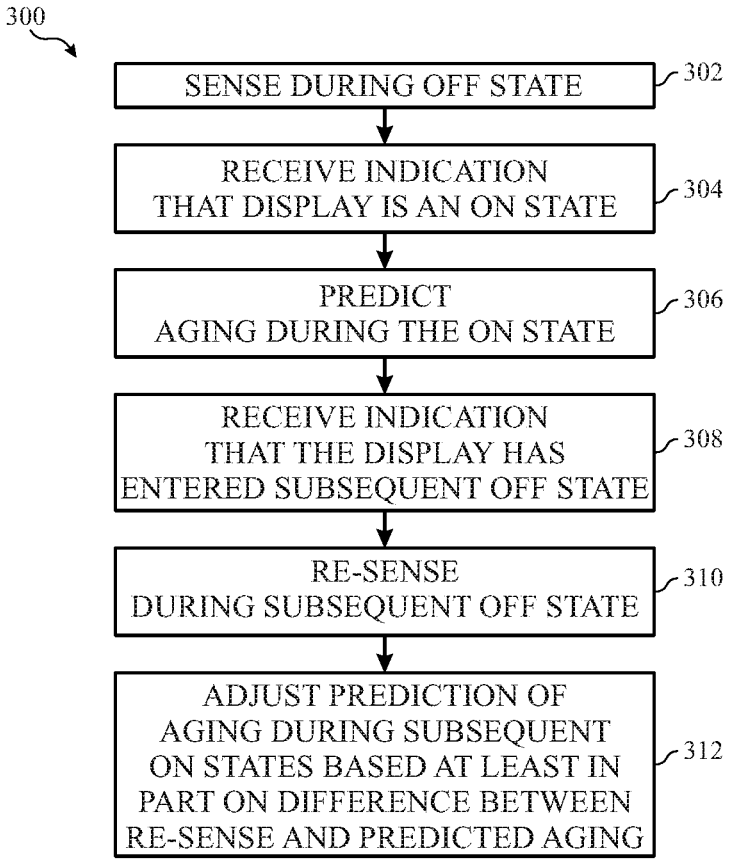
FIG. 14 illustrates a flow diagram view of a process for on state estimation of aging, in accordance with an embodiment.

FIG. 14 illustrates a process 300 used to implement on time aging estimation. The sensing circuitry 19 senses the display 18 during an off state for the display 18 (block 302). The processor(s) 12 receive an indication that the display is an on state (block 304). For example, the processor(s) 12 may receive an indication to turn the display 18 on via the input structures 20, send a signal to turn on the display 18, and receive a return signal as the indication that the display 18 has entered the on state. The processor(s) 12 then predict aging during the on state based on the off-time sensing (block 306). The prediction may be based on real-time content since the off-time sensing, brightness level for the display 18, temperature information, and/or a difference between the results of the off-time sensing and a previous estimation of aging.

The processor(s) 12 receive an indication that the display 18 has entered into a subsequent off state (block 308). During the subsequent off state, the sensing circuitry 19 re-senses the display 18 (block 310). The processor(s) 12 and/or the sensing circuitry 19 adjust prediction of aging during subsequent on states of the display 18 based at least in part on a difference between re-sense aging values and the predicted aging (block 312). The prediction of aging during subsequent on states may also be based at least in part on real-time content since the off-time sensing, brightness level for the display 18, and/or temperature information.

Figure 15:
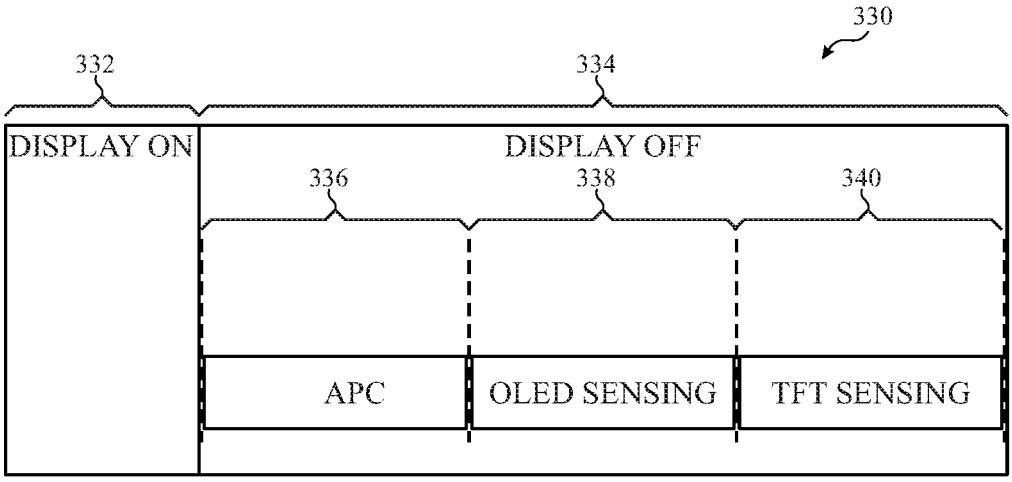
FIG. 15 illustrates a timing diagram of an off state having three sensing phases, in accordance with an embodiment.

Since the TFTs and related circuitry (e.g., capacitors) in the display 18 may include some hysteresis, the processor(s) 12 may utilize active panel conditioning to toggle the TFTs to reduce previous content's impact to TFT characteristics during the TFT sensing. FIG. 15 illustrates a timing diagram 330 that may be used for the display 18. The timing diagram 330 illustrates that the display 18 may be in an on state 332 and then an off state 334. During the off state 334, the display 18 undergoes three sensing states: active panel conditioning (APC) 336, emissive element (e.g., OLED) sensing 338, and TFT sensing 340. The APC 336, emissive element sensing 338, and/or TFT sensing 340 may utilize a common duration (e.g., 10 minutes) or may utilize different durations.

Figure 16:
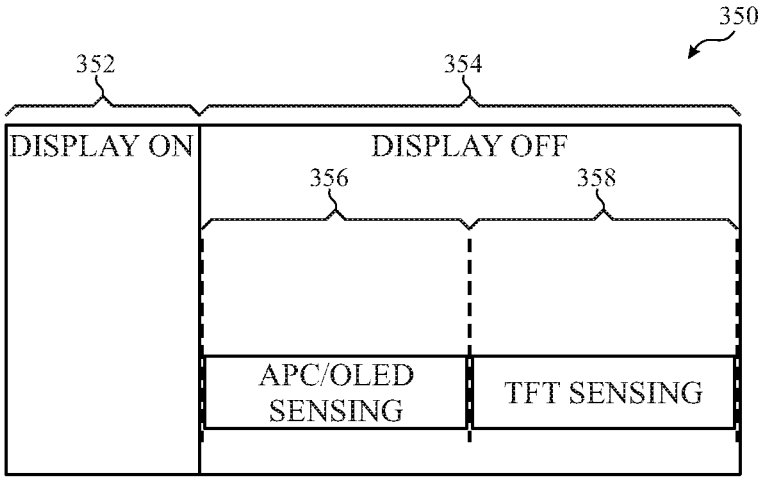
FIG. 16 illustrates a timing diagram of an off state having two sensing phases, in accordance with an embodiment.

In some embodiments, to reduce an overall sensing duration in the off state 334, the APC 336 and the emissive element sensing 338 may occur with at least some overlap (e.g., may be performed concurrently). FIG. 16 illustrates a timing diagram 350 that may be used for the display 18. The timing diagram 350 illustrates that the display 18 may be in an on state 352 and then an off state 354. During the off state 354, the display 18 undergoes two sensing states: APC/OLED sensing 356 and TFT sensing 358. The APC/OLED sensing 356 and the TFT sensing 358 may utilize a common duration (e.g., 10 minutes) or may utilize different durations.

Figure 17:
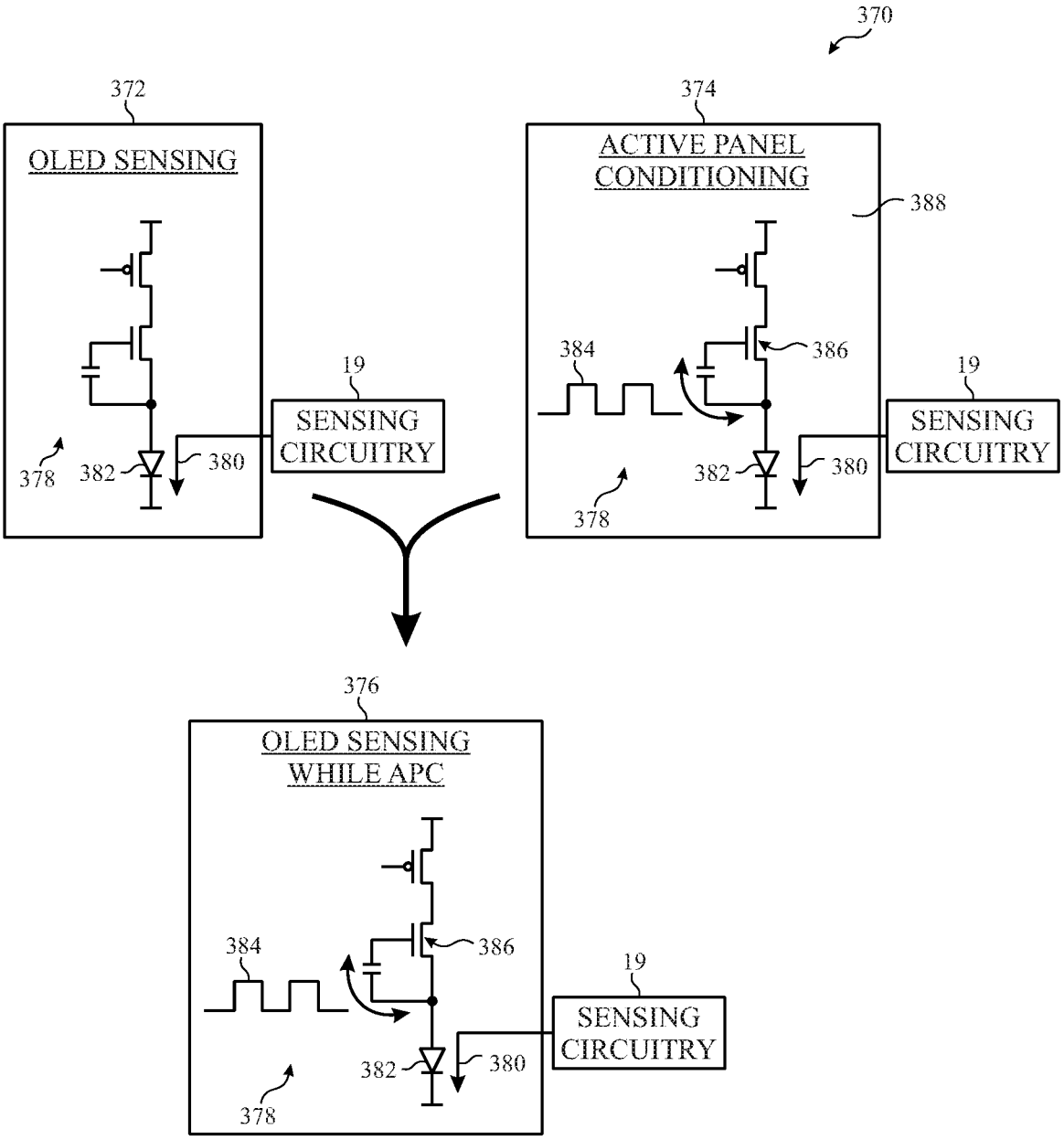
FIG. 17 illustrates a schematic diagram view reflecting the two sensing phases of FIG. 16, in accordance with an embodiment.

FIG. 17 illustrates a schematic diagram 370 illustrating why APC and emissive element sensing may be performed concurrently. The schematic diagram 370 includes an OLED sensing diagram 372, an APC diagram 374, and a compound diagram 376. The OLED sensing diagram 372 illustrates OLED sensing for a pixel 378 by injecting a current 380 into an emissive element 382 (e.g., OLED) from sensing circuitry 19. The sensing circuitry 19 also detects the voltage across the emissive element 382 to determine aging of the emissive element 382.

The APC diagram 374 illustrates that a signal 384 is injected into the TFT 386 to reduce previous content's impact to TFT characteristics during the TFT sensing. The APC diagram 374 illustrates that the signal 384 does not induce any current through the emissive element 382 because switch 388 does not allow current to flow through the TFT 386. Thus, since the signal 384 does not induce current through the emissive element 382 the current 380 may be used to sense the emissive element 382 while signal 384 is used to perform ADC.

Figure 18:
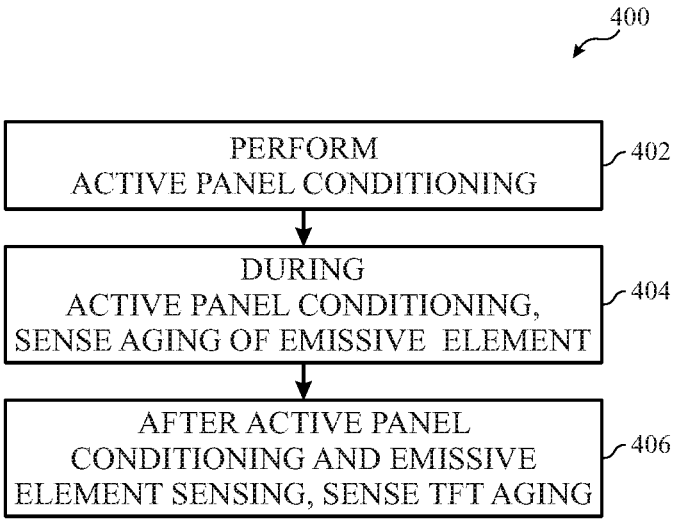
FIG. 18 illustrates a flow diagram view performing active panel conditioning concurrently with emissive element sensing, in accordance with an embodiment.

FIG. 18 illustrates a process 400 that may be used to perform APC and OLED sensing for the display 18 concurrently. The display 18 performs APC (block 402). In some embodiments, the APC may be performed by the processor(s) generating the signal 384 and the display applying the signal to TFTs of the display 18. During the APC, the sensing circuitry 19 senses aging of an emissive element (block 404). After APC and emissive element sensing have completed, the sensing circuitry 19 senses TFT aging (block 406).

The specific embodiments described above have been shown by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure. Furthermore, it should be further understood that each of the embodiments disclosed above may be used with any and all of the other embodiments disclosed herein. The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

What is claimed is:

1. A method comprising:

tracking usage of a display using a display usage time counter;

determining whether the display usage time counter has surpassed a first threshold and whether the display is off;

upon determining that the display usage time counter has surpassed the first threshold and that the display is off, sensing the display to obtain a compensation value, wherein sensing the display comprises sensing current through an emissive element of the display to determine a compensation voltage as the compensation value used to obtain a target current;

determining whether the display usage time counter has surpassed a second threshold and whether the display is off;

upon determining that the display usage time counter has surpassed the second threshold and that the display is off, determining whether the display is connected to external power;

upon determining that the display is connected to external power, that the display is off, and that the display usage time counter has surpassed the second threshold, sensing the display to obtain the compensation value; and driving the display based at least in part on the compensation value.

2. The method of claim 1, wherein the compensation voltage is configured to offset effects of aging on the emissive element.

3. The method of claim 1, wherein the emissive element comprises a self-emissive element.

4. The method of claim 3, wherein the self-emissive element comprises an organic light emitting diode.

5. The method of claim 1, comprising, upon determining that the display usage time counter has not surpassed the first threshold or that the display is not off, delaying sensing until at least a next available sensing period.

6. The method of claim 1, comprising, upon determining that the display usage time counter has not surpassed the second threshold or that the display is not off, delaying sensing until at least a next available sensing period.

7. Non-transitory, computer-readable, and tangible medium storing instructions thereon, that when executed, are configured to cause one or more processors to:

set a first indication that a first sensing type for a display panel is to occur during an off period for the display panel, wherein the first sensing type comprises emissive element sensing;

set a second indication that a second sensing type for the display panel is to occur during the off period for the display panel, wherein the second sensing type comprises thin film transistor sensing;

determine whether the first sensing type and the second sensing type are to occur within a threshold time of each other;

upon determining that the first sensing type and the second sensing type are not to occur within the threshold time of each other, perform a first sensing having the first sensing type and perform a second sensing having the second sensing type; and upon determining that the first sensing type and the second sensing type are to occur within the threshold time of each other, delay the first sensing and performing the second sensing.

8. The non-transitory, computer-readable, and tangible medium of claim 7, wherein the emissive element sensing comprises current sensing through an emissive element relative to a voltage drop across the emissive element to derive a compensation voltage to be added to the voltage drop to achieve a target current.

9. The non-transitory, computer-readable, and tangible medium of claim 8, wherein the compensation voltage is configured to compensate for aging of the emissive element.

10. The non-transitory, computer-readable, and tangible medium of claim 7, wherein setting the first indication comprises determining whether a usage counter has surpassed a first threshold corresponding to a battery-power or a second threshold corresponding to a line-powered condition.

11. The non-transitory, computer-readable, and tangible medium of claim 7, wherein setting the second indication comprises determining whether a usage counter has surpassed a first threshold corresponding to a battery-power or a second threshold corresponding to a line-powered condition.

12. A system comprising:

a display having sensing circuitry configured to sense parameters of the display during an off state of the display, wherein sensing the display comprises sensing using emissive element sensing and sensing using thin film transistor sensing;

a processor; and memory storing instructions that, when executed, are configured to cause the processor to:

cause the sensing circuitry to scan the display in a frame-by-frame basis;

determine whether a user interrupt has occurred during the scan;

upon determination that no user interrupt has occurred during the scan:

determine whether a frame of the scan has been completed; and upon completion of the frame, store frame data for the frame to update compensation values for driving the display; and upon determination that the user interrupt has occurred during the scan, abandon current frame data and begin the frame of the scan again at a later scanning opportunity.

13. The system of claim 12, wherein the parameters of the display comprise non-uniformity of the display.

14. The system of claim 13, wherein the non-uniformity of the display is a result of aging of emissive elements or transistors in the display.

15. The system of claim 12, wherein the instructions are configured to cause the processor to operate the display with the updated compensation values.

16. A method comprising:

sensing a display during an off state of the display, wherein sensing the display derives compensation values to compensate for non-uniformity of the display when the display is driven and wherein sensing the display comprises sensing using emissive element sensing and sensing using thin film transistor sensing;

receiving an indication that the display is in an on state;

predicting aging during the on state based at least in part on the sensing of the display in the off state;

receiving an indication that the display has entered a subsequent off state;

re-sensing during the subsequent off state to obtain re-sensing values; and adjusting prediction of aging during subsequent on states based at least in part on a difference between re-sensing values and the predicted aging.

17. The method of claim 16, wherein emissive element sensing comprises current sensing through an emissive element relative to a voltage drop across the emissive element to derive a compensation voltage to be added to the voltage drop to achieve a target current.

18. A method comprising:

performing active panel conditioning to reduce hysteresis in pixels of a display panel during an off state of the display panel;

during active panel conditioning, sensing aging effects of an emissive element of the display panel;

after active panel conditioning and the sensing aging effects of the emissive element have completed, sensing thin film transistor aging of the display panel;

predicting aging during an on state based at least in part on the sensing of the display panel in the off state;

receiving an indication that the display panel has entered a subsequent off state;

re-sensing during the subsequent off state to obtain re-sensing values; and adjusting prediction of aging during subsequent on states based at least in part on a difference between re-sensing values and the predicted aging.

* * * * *